US011813883B2

(12) United States Patent
Takenaga et al.

(10) Patent No.: US 11,813,883 B2
(45) Date of Patent: Nov. 14, 2023

(54) ELECTROPHOTOGRAPHIC MEMBER AND ELECTROPHOTOGRAPHIC IMAGE FORMING APPARATUS

(71) Applicant: CANON KABUSHIKI KAISHA, Tokyo (JP)

(72) Inventors: Masahiro Takenaga, Kawasaki (JP); Keisuke Abe, Yokohama (JP); Kenji Onuma, Machida (JP); Kouichi Uchida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 277 days.

(21) Appl. No.: 17/062,380

(22) Filed: Oct. 2, 2020

(65) Prior Publication Data

US 2021/0103236 A1 Apr. 8, 2021

(30) Foreign Application Priority Data

Oct. 3, 2019 (JP) ..... 2019-182996

(51) Int. Cl.
*B41M 5/50* (2006.01)
*B41M 5/52* (2006.01)

(52) U.S. Cl.
CPC ..... *B41M 5/529* (2013.01); *B41M 5/5245* (2013.01)

(58) Field of Classification Search
CPC ..... B41M 5/529; B41M 5/5245
USPC ..... 428/32.51
See application file for complete search history.

(56) References Cited

U.S. PATENT DOCUMENTS

2014/0234628 A1* 8/2014 Takenaga ..... G03G 15/0189 399/302
2014/0377564 A1 12/2014 Sakamoto
2014/0377695 A1* 12/2014 Kameyama ..... G03G 5/14726 430/96
2019/0004454 A1 1/2019 Karube
2021/0103236 A1* 4/2021 Takenaga ..... B41M 5/5245

FOREIGN PATENT DOCUMENTS

JP 2015028613 A 2/2015
JP 2015028614 A 2/2015
JP 2019012265 A 1/2019
JP 2019148755 A 9/2019

* cited by examiner

*Primary Examiner* — Betelhem Shewareged
(74) *Attorney, Agent, or Firm* — Canon U.S.A., Inc., IP Division

(57) ABSTRACT

An electrophotographic member capable of further reducing adhesion of a toner to an outer surface. The electrophotographic member comprises a base layer and a surface layer laminated in this order in a thickness direction of the electrophotographic member, the surface layer containing a binder resin, perfluoropolyether, and an ionic liquid, a content of the perfluoropolyether with respect to the binder resin being 20% by mass or more and 100% by mass or less, and a contact angle of a surface on a side of the surface layer that is opposite to a side facing the base layer with respect to hexadecane being 65° or more.

11 Claims, 4 Drawing Sheets

ELECTROPHOTOGRAPHIC MEMBER AND ELECTROPHOTOGRAPHIC IMAGE FORMING APPARATUS

BACKGROUND

Field

The present disclosure relates to an electrophotographic member and an electrophotographic image forming apparatus including the electrophotographic member.

Description of the Related Art

An intermediate transfer belt is one of members used in an electrophotographic image forming apparatus. In the electrophotographic apparatus requiring high image quality, it is required to further enhance transfer characteristics of the intermediate transfer belt. As an example, measures for enhancing the transfer characteristics by performing various treatments on a surface of the intermediate transfer belt have been carried out. Japanese Patent Application Laid-Open No. 2015-028613 discloses an electrophotographic member having a surface layer containing perfluoropolyether having water repellency and oil repellency to reduce an adhesive force of a toner to an outer surface which is a toner carrying surface of the electrophotographic member.

Recently, a demand for higher image quality of an electrophotographic image has been increased. Accordingly, the present inventors have recognized that in an electrophotographic image forming process, for an electrophotographic member carrying a toner such as an intermediate transfer belt, it is required to further reduce adhesion of the toner to an outer surface which is a toner carrying surface. According to studies conducted by the present inventors, in the electrophotographic member according to Japanese Patent Application Laid-Open No. 2015-028613, even though a content of the perfluoropolyether in the surface layer was simply increased, the effect of reducing the adhesion of the toner to the outer surface of the electrophotographic member was limited.

SUMMARY

At least one of aspects of the present disclosure is directed to providing an electrophotographic member capable of further reducing adhesion of a toner to an outer surface. At least one of aspects of the present disclosure is directed to providing an electrophotographic image forming apparatus capable of forming a high quality electrophotographic image.

According to at least one aspect of the present disclosure, there is provided an electrophotographic member comprising a base layer and a surface layer laminated in this order in a thickness direction of the electrophotographic member, the surface layer containing a binder resin, perfluoropolyether, and an ionic liquid, a content of the perfluoropolyether with respect to the binder resin being 20% by mass or more and 100% by mass or less, and the ionic liquid having an anion represented by the following Formula (1):

Formula (1)

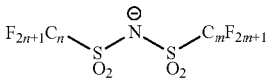

wherein m and n each independently represent an integer of 1 or more and 4 or less.

According to at least one aspect of the present disclosure, there is provided an electrophotographic member comprising a base layer and a surface layer laminated in this order in a thickness direction of the electrophotographic member, the surface layer containing a binder resin, perfluoropolyether, and an ionic liquid, a content of the perfluoropolyether with respect to the binder resin is 20% by mass or more and 100% by mass or less, and a contact angle of a surface on a side of the surface layer that is opposite to a side facing the base layer with respect to hexadecane being 65° or more.

According to at least one aspect of the present disclosure, there is provided an electrophotographic image forming apparatus including the electrophotographic member.

Further features of the present disclosure will become apparent from the following description of exemplary embodiments with reference to the attached drawings.

DESCRIPTION OF THE EMBODIMENTS

As described above, according to the studies conducted by the present inventors, in the electrophotographic member according to Japanese Patent Application Laid-Open No. 2015-028613, even though the content of the perfluoropolyether (PFPE) in the surface layer was increased, the effect of reducing the adhesion of the toner to the outer surface of the electrophotographic member was limited.

The reason is that in the surface layer containing a binder resin and PFPE dispersed in the binder resin, the PFPE is likely to be unevenly distributed on an interface between a surface layer 22 and air, that is, on the outer surface of the surface layer due to its small surface free energy. Accordingly, it is difficult for the toner to adhere to the outer surface of the electrophotographic member. However, there is an upper limit to the amount of PFPE that can be present in the vicinity of the outer surface of the surface layer, and even though the PFPE is contained in the surface layer in a predetermined amount or more, an excessive amount of PFPE is only present inside the surface layer. Therefore, it was difficult to further reduce the adhesion of the toner to the outer surface of the electrophotographic member by adding the excessive amount of the PFPE.

Thus, the present inventors have conducted intensive studies to further reduce the adhesion of the toner to the outer surface of the electrophotographic member by a method other than increasing the content of the PFPE. As a result, the present inventors found that a surface layer containing PFPE and an ionic liquid having an anion represented by the following Structural Formula (1) can implement an outer surface to which a toner hardly adheres.

Structural Formula (1)

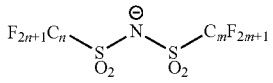

Wherein m and n each independently represent an integer of 1 or more and 4 or less.

The present inventors presume the reason why the surface layer containing PFPE and an ionic liquid having an anion having a structure represented by Structural Formula (1) implements the outer surface to which a toner hardly adheres as follows.

Figure 3:
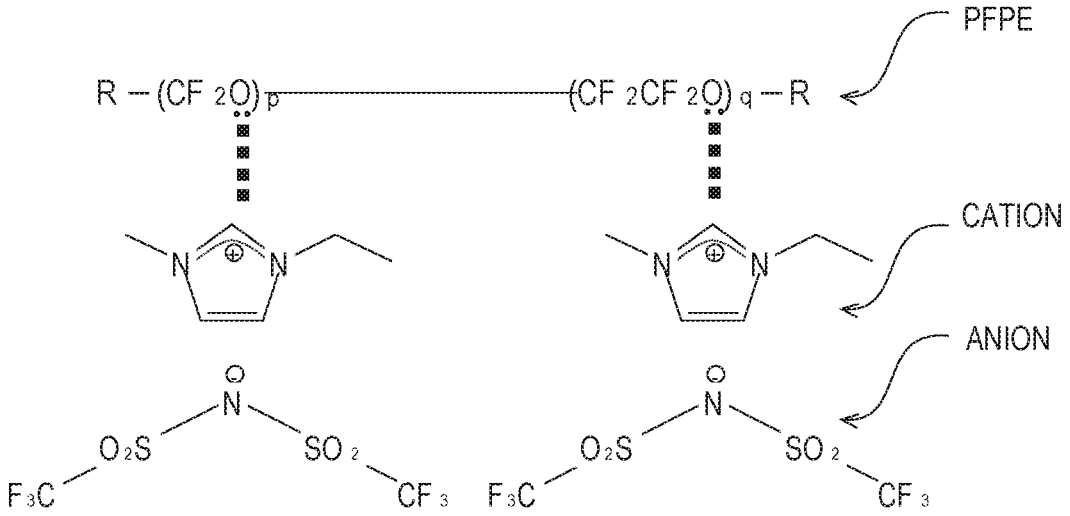
FIG. 3 is an explanatory view of a presumed mechanism of effect expression of the electrophotographic member according to an embodiment of the present disclosure.

Unshared electron pairs are present in an ether structure of the PFPE. Therefore, as illustrated in FIG. 3, the ether structure of the PFPE interacts with a cation of the ionic liquid, and more cations are present in the vicinity of the ether structure. Thus, the anion which is a counter ion is present in the vicinity of the cation. In this case, the anion is an anion having a structure represented by Structural Formula (1) having perfluoroalkyl groups in a molecule, such that more perfluoroalkyl groups are present in the vicinity of the PFPE. Therefore, it is considered that the adhesion of the toner to the outer surface of the surface layer can be further reduced because the perfluoroalkyl groups are oriented toward the outer surface of the surface layer. It should be noted that the PFPE illustrated in FIG. 3 is an example, and each of p and q represents an integer of 0 or 1 or more, and p and q are not zero at the same time. R represents a terminal group of the PFPE and is selected from a reactive functional group or non-reactive functional group to be described below. In addition, the cation of the ionic liquid also shows a preferred example.

It is possible to obtain an electrophotographic member having an outer surface having a contact angle of 65° or more with respect to hexadecane (hereinafter, simply referred to as a "contact angle") is by using both the ionic liquid having a specific anion and the PFPE, the contact angle being considered to be difficult to achieve with PFPE alone. The contact angle is 65° or more, such that an unprecedented low toner adhesion is exhibited.

The present inventors have thought that a value of the high contact angle cannot be achieved by, for example, an ionic liquid having an anion having only one perfluoroalkyl group such as a trifluoromethanesulfonate anion as an ionic liquid contained in the surface layer together with PFPE.

Furthermore, a contact angle which can be achieved by containing a specific amount of PFPE in the surface layer can be achieved by using both the ionic liquid containing the specific anion and the PFPE even though a content of PFPE is reduced from the specific amount of PFPE. That is, a used amount of PFPE can be reduced, which can save a manufacturing cost of the electrophotographic member.

Hereinafter, an electrophotographic member according to an embodiment of the present disclosure will be described with reference to an example of an electrophotographic member having an endless shape (hereinafter, referred to as an "electrophotographic belt"). It should be noted that the electrophotographic member according to the present disclosure is not limited to the following embodiment. Specifically, for example, as another form of the electrophotographic member, an electrophotographic member having a roller shape can be included.

<Electrophotographic Member>

Figure 2:
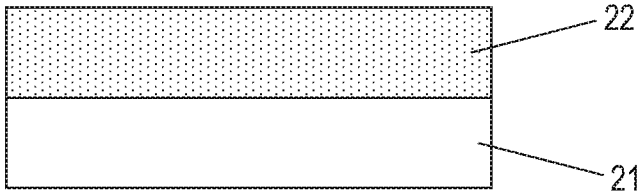
FIG. 2 is a schematic cross-sectional view illustrating an electrophotographic member according to an embodiment of the present disclosure in a thickness direction.

An electrophotographic belt 7 illustrated in FIG. 2 has a base layer 21 and a surface layer 22 provided on an outer circumferential surface of the base layer 21. That is, the base layer and the surface layer are laminated in this order in a thickness direction.

The surface layer 22 contains a binder resin, PFPE, and an ionic liquid. A content of the PFPE with respect to the binder resin in the surface layer is 20% by mass or more and 100% by mass or less. Furthermore, the ionic liquid has an anion having a structure represented by Structural Formula (1).

As a result of studies of the present inventors, the following was disclosed. A contact angle of a surface (outer surface) on a side of the surface layer that is opposite to a side facing the base layer with respect to hexadecane has a positive correlation with the adhesion of the toner to the outer surface, the surface being a toner carrying surface of the electrophotographic member. That is, the higher the value of the contact angle, the smaller the adhesion of the toner. Therefore, in the present disclosure, the low toner adhesion of the electrophotographic member is determined by using the contact angle with respect to hexadecane.

The electrophotographic member may be formed of only the two layers, or may also include another member on a surface (a back surface of the electrophotographic member) on the side of the surface layer that is opposite to the side facing the base layer, in addition to the two layers.

<Base Layer>

In general, an electro-conductive substance can be added to the base layer 21 to impart electro-conductivity to the base layer 21. Examples of the electro-conductive substance can include a carbon-based inorganic electro-conductive particle such as carbon black, a carbon fiber, or a carbon tube, and an inorganic electro-conductive particle formed of metal oxide such as zinc antimonate, zinc oxide, tin oxide, or titanium oxide. When the base layer 21 is used as an intermediate transfer belt, a volume resistivity of the base layer 21 is preferably adjusted in a range of $1\times10^{8}$ Ω•cm or more and $1\times10^{12}$ Ωcm or less. In addition, a surface resistivity of the base layer 21 is preferably adjusted in a range of $1\times10^{8}$Ω/□ or more and $1\times10^{14}$Ω/□ or less.

When the volume resistivity of the base layer 21 is $1\times10^{12}$ Ω•cm or less, a predetermined transfer bias is applied, such that a reduction in primary transferability and secondary transferability can be suppressed. In addition, when the volume resistivity of the base layer 21 is $1\times10^{8}$ Ω•cm or more, unevenness in resistance can be suppressed, and unevenness in transfer and image failure can be prevented. In addition, by setting the surface resistivity of the base layer 21 in the above range, image failure due to peeling discharge or toner scattering when a transfer material is separated from the intermediate transfer belt can be reduced. A thickness of the base layer 21 is preferably 30 μm or more and 150 μm or less in terms of mechanical strength and bending resistance.

<Surface Layer>

The surface layer 22 contains a binder resin, PFPE, and an ionic liquid. In addition, the surface layer 22 may contain an additive such as a photopolymerization initiator, a dispersant, or an electro-conductive agent, in addition to the binder resin, the PFPE, and the ionic liquid.

Binder Resin

A styrene resin, an acrylic resin, a methacrylic resin, an epoxy resin, a polyester resin, a polyether resin, a silicone resin, or a polyvinyl butyral resin, or a mixed resin thereof can be used as the binder resin.

The binder resin is used to disperse the PFPE, ensure adhesion to the base layer 21, and ensure characteristics of mechanical strength. Among the above binder resins, a methacrylic resin or an acrylic resin is preferably used because the methacrylic resin or the acrylic resin can preferably disperse the PFPE constituting the surface layer 22 according to the present disclosure. Hereinafter, the acrylic resin and the methacrylic resin are collectively called "acrylic resin".

Examples of a polymerizable monomer to form the acrylic resin can include the following (i) and (ii). A commercially available polymerizable monomer as a coating material can be used as the polymerizable monomer.

(i) At least one acrylate selected from the group consisting of pentaerythritol triacrylate, pentaerythritol tetraacrylate, ditrimethylolpropane tetraacrylate, dipentaerythritol hexaacrylate, alkyl acrylate, benzyl acrylate, phenyl acrylate, ethylene glycol diacrylate, and bisphenol A diacrylate.

(ii) At least one methacrylate selected from the group consisting of pentaerythritol trimethacrylate, pentaerythritol tetramethacrylate, ditrimethylolpropane tetramethacrylate, dipentaerythritol hexamethacrylate, alkyl methacrylate, benzyl methacrylate, phenyl methacrylate, ethylene glycol dimethacrylate, and bisphenol A dimethacrylate.

Among them, a polymerizable monomer having high hardness is preferably used in consideration of rubbing with another member such as a photosensitive member or a cleaning blade. Therefore, a large quantity of bifunctional or higher functional cross-linkable monomer is also preferably used for the acrylic resin to impart higher hardness.

In addition, a method of adding a photopolymerization initiator and performing polymerization through an electron beam or ultraviolet ray can be used to form the acrylic resin from such a polymerizable monomer.

Examples of the photopolymerization initiator can include radical-generating photopolymerization initiators such as benzophenone, thioxanthones, benzil dimethylketal, α-hydroxyketone, α-hydroxyalkylphenone, α-aminoketone, α-aminoalkylphenone, monoacylphosphine oxide, bisacylphosphine oxide, hydroxybenzophenone, aminobenzophenone, titanocenes, oxime ester, and oxyphenyl acetate.

A content of the binder resin is preferably 20% by mass or more with respect to a mass of a total solid content of the surface layer 22 from the viewpoint of strength of the surface layer. In addition, the content of the binder resin is preferably 70% by mass or less from the viewpoint of preventing the low toner adhesion from being insufficient due to a relative decrease in PFPE and ionic liquid components in accordance with an increase in the content of the binder resin.

In addition, a thickness of the surface layer 22 is desirably 1 μm or more and 20 μm or less. When the thickness of the surface layer 22 is 1 μm or more, both the low toner adhesion and peeling suppression can be maintained, such that durability can be ensured. When the thickness of the surface layer 22 is 20 μm or less, a required bending resistance can be obtained.

(PFPE)

Perfluoropolyether (PFPE) refers to an oligomer or polymer having perfluoroalkyleneoxy as a repeating unit.

Examples of the repeating unit of perfluoroalkyleneoxy can include repeating units such as difluoromethyleneoxy (—$CF_2O$—), tetrafluoroethyleneoxy (—$CF_2CF_2O$—), and hexafluoropropyleneoxy (—$CF_2CF_2CF_2$—O— or —$C(CF_3)FCF_2O$—).

Any one of PFPE having a reactive functional group that can form a bond or a structure close to a bond with the binder resin and PFPE having a non-reactive functional group that cannot form a bond or a structure close to a bond with the binder resin can be used as the PFPE.

In the case of the PFPE having the reactive functional group, a preferred compatibility between the binder resin and the PFPE can be achieved through an interaction with the binder resin, and the PFPE can be stably dispersed in the binder resin. In a case where the binder resin is formed through an addition reaction, examples of the reactive functional group which causes an addition reaction with a monomer to form a binder resin can include an acrylic group, a methacrylic group, and an oxysilanyl group.

Examples of the PFPE having an acrylic group or a methacrylic group can include "Fluorolink MD500", "Fluorolink MD700", "Fluorolink 5101X", "Fluorolink 5113X", and "Fluorolink AD1700" (trade name, all produced by Solvay Specialty Polymers, LLC), and "OPTOOLDAC" (trade name, produced by Daikin Industries, Ltd.).

In addition, in the case where the binder resin is formed through the addition reaction, examples of the non-reactive functional group which does not undergo an addition reaction with a monomer to form a binder resin can include a hydroxyl group, a trifluoromethyl group, and a methyl group.

Examples of such a PFPE can include "Fomblin D2", "Fomblin M60", and "Fluorolink S10" (trade name, all produced by Solvay Specialty Polymers, LLC), and "DEMNUM S-20", "DEMNUM S-65", and "DEMNUM S-200" (trade name, all produced by Daikin Industries, Ltd.).

Among them, the PFPE preferably has a non-reactive functional group from the viewpoint of the low toner adhesion to the surface of the electrophotographic member.

In addition, the content of the PFPE with respect to the binder resin (100% by mass) in the surface layer needs to be 20% by mass or more to allow the PFPE to be sufficiently present in the vicinity of the surface on the side of the surface layer 22 that is opposite to the side facing the base layer 21. In addition, when a content of oily PFPE is too high, the PFPE oozes out from the surface of the electrophotographic member and adheres to the toner, which deteriorates the low toner adhesion. Thus, the content of the PFPE with respect to the binder resin in the surface layer needs to be 100% by mass or less.

Ionic Liquid

The ionic liquid is a liquid having a cation and an anion. The ionic liquid is a salt which is present as a liquid in a broad temperature range, and in particular, refers to a salt having a melting point of 100° C. or lower and obtained by using a relatively large organic ion as an ion species constituting such a salt.

When the ionic liquid in the present disclosure is used in the electrophotographic member, an ionic liquid having an anion having perfluoroalkyl groups is preferably used from the viewpoint of the low toner adhesion, that is, improvement of the contact angle with respect to hexadecane.

Anion (Negative Ion)

As an anion species constituting the ionic liquid, a sulfonylimide ion having two perfluoroalkyl groups represented by the following Structural Formula (1) can be used.

Structural Formula (1)

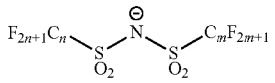

Wherein m and n each independently represent an integer of 1 or more and 4 or less.

Examples of the anion satisfying Structural Formula (1) can include a bis(trifluoromethanesulfonyl)imide ion, a bis(perfluoroethanesulfonyl)imide ion, a bis(perfluoropropanesulfonyl)imide ion, a bis(nonafluorobutanesulfonyl)imide ion (also referred to as a bis(perfluorobutanesulfonyl)imide ion), a trifluoromethanesulfonyl perfluoropropane sulfonylimide ion, and a trifluoromethanesulfonyl perfluorobutane sulfonylimide ion.

Cation (Positive Ion)

A cation species constituting the ionic liquid is not particularly limited, and a positive ion which is paired with the sulfonylimide ion represented by Structural Formula (1) and constitutes the ionic liquid can be used.

Preferred specific examples of the cation can include a cation selected from the group consisting of structures represented by the following Structural Formulas (2) to (7) and a cation having a reactive functional group represented by the following Structural Formula (8).

Structural Formula (2)

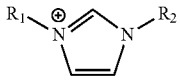

Structural Formula (3)

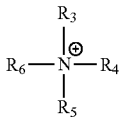

Structural Formula (4)

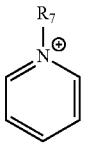

Structural Formula (5)

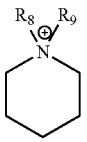

Structural Formula (6)

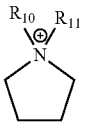

Structural Formula (7)

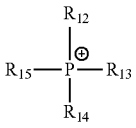

Wherein $R_1$ to $R_{15}$ each independently represent a hydrocarbon group having 1 to 8 carbon atoms.

Examples of the hydrocarbon group can include the following hydrocarbon groups: i) a linear or branched saturated hydrocarbon group having 1 to 8 carbon atoms; ii) a linear or branched unsaturated hydrocarbon group having 2 to 8 carbon atoms; iii) a substituted or unsubstituted saturated alicyclic hydrocarbon group having 3 to 8 carbon atoms; iv) a substituted or unsubstituted unsaturated alicyclic hydrocarbon group having 4 to 8 carbon atoms; and v) a substituted or unsubstituted aromatic hydrocarbon group having 6 carbon atoms (phenyl group). Here, examples of substituents of the saturated alicyclic hydrocarbon group, the unsaturated alicyclic hydrocarbon group, and the aromatic hydrocarbon group can include alkyl groups having 1 to 3 carbon atoms. It should be noted that the number of carbons of "the hydrocarbon group having 1 to 8 carbon atoms" is the number of carbons also including the number of carbons of the substituent.

Structural Formula (8)

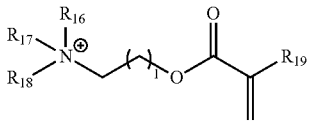

Wherein $R_{16}$ to $R_{18}$ each independently represent a hydrocarbon group having 1 to 8 carbon atoms. Examples of the hydrocarbon group can include the same groups as $R_1$ to $R_{15}$ of Structural Formulas (2) to (7). In addition, $R_{19}$ represents hydrogen or a methyl group, and 1 represents an integer of 1 or more and 8 or less.

Hereinafter, each cation will be described in detail. Here, a) an imidazolium-based ion (Structural Formula (2)), b) an ammonium-based ion (Structural Formula (3)), c) a pyridinium-based ion (Structural Formula (4)), d) a piperidinium-based ion (Structural Formula (5)), e) a pyrrolidinium-based ion (Structural Formula (6)), f) a phosphonium-based ion (Structural Formula (7)), and g) an acryloyl or methacryloyl-based ion (Structural Formula (8)) will be described in this order.

a) Imidazolium-Based Ion

Specific examples of the imidazolium-based ion represented by Structural Formula (2) can include the following:

a 1-ethyl-3-methylimidazolium ion, a 1-butyl-3-methylimidazolium ion, a 1-hexyl-3-methylimidazolium ion, a 1-methyl-3-octylimidazolium ion, a 1-(tert-butyl)-3-methylimidazolium ion, a 1-phenyl-3-methylimidazolium ion, and a 1-(2,4-dimethylphenyl)-3-methylimidazolium ion.

b) Ammonium-Based Ion

Specific examples of the ammonium-based ion represented by Structural Formula (3) can include the following:

an N,N,N-trimethyl-N-propylammonium ion (TMPA), an N,N,N-tributyl-N-methylammonium ion, an N,N,N-trioctyl-N-methylammonium ion, an N-butyl-N,N,N-trimethylammonium ion, an N-(tert-butyl)-N,N,N-trimethylammonium ion, an N-phenyl-N,N,N-trimethylammonium ion, and an N-(2,4-dimethylphenyl)-N,N,N-trimethylammonium ion.

c) Pyridinium-Based Ion

Specific examples of the pyridinium-based ion represented by Structural Formula (4) can include the following:

a 1-ethylpyridinium ion, a 1-butylpyridinium ion, a 1-hexylpyridinium ion, a 1-(tert-butyl)pyridinium ion, a 1-phenylpyridinium ion, and a 1-(2,4-dimethylphenyl)pyridinium ion.

d) Piperidinium-Based Ion

Specific examples of the piperidinium-based ion represented by Structural Formula (5) can include the following:

an N-methyl-N-ethylpiperidinium ion, an N-methyl-N-propylpiperidinium ion, an N-(tert-butyl)-N-methylpiperidinium ion, an N-phenyl-N-methylpiperidinium ion, and an N-(2,4-dimethylphenyl)-N-methylpiperidinium ion.

e) Pyrrolidinium-Based Ion

Specific examples of the pyrrolidinium-based ion represented by Structural Formula (6) can include the following:

an N-methyl-N-propylpyrrolidinium ion, an N-methyl-N-butylpyrrolidinium ion, an N-(tert-butyl)-N-methylpyrrolidinium ion, an N-phenyl-N-methylpyrrolidinium ion, and an N-(2,4-dimethylphenyl)-N-methylpyrrolidinium ion.

f) Phosphonium-Based Ion

Specific examples of the phosphonium-based ion represented by Structural Formula (7) can include the following:

a trimethylpropylphosphonium ion, a tributylmethylphosphonium ion, a triethylpentylphosphonium ion, a (tert-butyl)-trimethylphosphonium ion, a phenyl-trimethylphosphonium ion, and a (2,4-dimethylphenyl)-trimethylphosphonium ion.

g) Acryloyl or Methacryloyl-Based Ion

Specific examples of the acryloyl or methacryloyl-based ion represented by Structural Formula (8) can include the following:

a (2-acryloyloxyethyl)trimethylammonium ion, a (2-methacryloyloxyethyl)trimethylammonium ion, a (2-acryloyloxyethyl)tributylammonium ion, and a (2-methacryloyloxyethyl)tributylammonium ion.

Among the cations represented by Structural Formulas (2) to (8), in the case of the cation having a planar ring structure (Structural Formula (2), Structural Formula (4), Structural Formula (5), or Structural Formula (6)), steric hindrance is small when interacting with the PFPE. Therefore, the cation interacts with an ether group moiety without covering a perfluoroalkyl group moiety of the PFPE, which is preferable in terms of further improving the low toner adhesion of the electrophotographic member. Among them, the imidazolium-based ion represented by Structural Formula (2) is more preferable in terms of the smallest steric hindrance.

In addition, the acryloyl or methacryloyl-based ion represented by Structural Formula (8) has a reactive functional group that can form a bond or a structure close to a bond with the binder resin when an acrylic resin is used as the binder resin. Therefore, the compatibility between the binder resin and the ionic liquid becomes better due to the interaction with the binder resin, and the ionic liquid is stably dispersed, which is preferable from the viewpoint of the strength of the surface layer as compared with the case of using an equivalent amount of another ionic liquid.

In addition, a content of the ionic liquid in the surface layer is preferably 25% by mass or more, and particularly preferably 50% by mass or more, with respect to the content (100% by mass) of the PFPE to ensure that the cation of the ionic liquid interacts with the ether structure of the PFPE. In addition, the content of the ionic liquid is preferably 150% by mass or less to effectively utilize the perfluoroalkyl group moiety of the PFPE to improve the contact angle of the surface.

It should be noted that the content of the ionic liquid can be determined by extracting the ionic liquid from the surface layer and quantifying the extracted ionic liquid. A solvent obtained by dissolving the above ionic liquid is selected as a solvent used for the extraction. A specific example thereof can include methyl ethyl ketone (MEK). The solvent in the extracted solution after the extraction is removed using a rotary evaporator or the like, and the ionic liquid is isolated by various chromatography, such that the content of the ionic liquid in the surface layer can be quantified.

Additive

The surface layer may contain an additive, if necessary, in a range in which the effects of the present disclosure are not impaired.

In order to stably form the PFPE in the surface layer of the electrophotographic member as a domain, a dispersant may also be used. As the dispersant, a compound having a moiety having an affinity with both a perfluoroalkyl chain and a hydrocarbon chain, that is, a compound having amphiphilic properties of fluorophilic and fluorophobic properties, for example, a surfactant, an amphiphilic block copolymer, or an amphiphilic graft copolymer is preferably used.

Among them, the dispersant is preferably the following (i) or (ii): (i) a block copolymer obtained by copolymerizing a vinyl monomer having a fluoroalkyl group and acrylate or methacrylate, or (ii) a comb graft copolymer obtained by copolymerizing acrylate or methacrylate having a fluoroalkyl group and a methacrylate macromonomer having polymethylmethacrylate as a side chain.

Examples of the block copolymer of (i) include "Modiper" (registered trademark) F200, F210, F2020, F600, and FT-600 produced by NOF CORPORATION.

In addition, examples of the comb graft copolymer of (ii) include "ARON" (registered trademark) GF-150, GF-300, GF-400, and GF-420 produced by TOAGOSEI CO., LTD., which are fluorine-based graft polymers.

In addition, an electro-conductive agent can be contained in the surface layer 22 to impart electro-conductivity to the surface layer 22. Examples of the electro-conductive agent can include a carbon-based electro-conductive particle such as carbon black, a carbon fiber, or a carbon tube, and a metal oxide such as zinc antimonate, zinc oxide, tin oxide, or titanium oxide.

Examples of other additives can include a filler particle, a lubricant, an electro-conductive aid, a curing agent, an antioxidant, an ultraviolet absorber, a pH adjuster, a cross-linking agent, a pigment, and a thickener that are known in the field.

<Method of Producing Electrophotographic Member>

Hereinafter, an electrophotographic image forming apparatus (electrophotographic apparatus) of the present disclosure including an intermediate transfer belt as an embodiment of the electrophotographic member according to the present disclosure will be described with reference to FIG. 1, but the present disclosure is not limited to the embodiment.

The base layer 21 of the intermediate transfer belt can be produced by the following method.

For example, in a case where a thermosetting resin such as polyimide is used, an electro-conductive agent and, if necessary, an additive are dispersed together with a thermosetting resin precursor or a soluble thermosetting resin and a solvent to form a varnish, and the varnish is coated to a mold of a centrifugal molding apparatus. Next, a semi-electro-conductive film is formed through a calcining process of the coated film.

In addition, in a case of using a thermosetting resin, an electro-conductive agent and a thermosetting resin, and if necessary, an additional additive are mixed with each other, and melted and kneaded by a twin-screw kneader or the like to prepare a semi-electro-conductive resin composition.

Next, the resin composition is extruded and molded into a sheet shape, a film shape, or a cylindrical shape through melt extrusion, and a base layer can thus be obtained.

A base layer having an endless shape can be formed, for example, from a resin tube obtained by melting and extruding the resin composition from a cylindrical dice. Alternatively, ends of the resin sheet or the resin film obtained by extruding and molding the resin composition into a sheet shape or a film shape, respectively, are connected to each other to form a cylindrical shape, and a base layer can also thus be formed. In addition, the base layer can also be formed by using a known molding method such as a heat press method, an injection molding method, a stretch blow molding method, or an inflation molding method, in addition to the extrusion molding method. In addition, the molded base layer may be subjected to surface treatment such as application of a treating agent or polishing treatment.

An example of a method of forming the surface layer 22 of the intermediate transfer belt can include the following method. First, a polymerizable monomer for forming the binder resin which is a constituent material of the surface layer 22, a polymerization initiator, PFPE, and an ionic liquid, and if necessary, a dispersant, an electro-conductive agent, and the other additives are dissolved and dispersed in an appropriate organic solvent, thereby obtaining a coating liquid for a surface layer. Next, the coating liquid for a surface layer is applied onto an outer circumference of the base layer 21 by a method such as a ring coating method, a dip coating method, or a spray coating method, and drying is performed at 60 to 90° C. to remove the organic solvent. Thereafter, the base layer is cured by ultraviolet rays using an ultraviolet irradiator to obtain an intermediate transfer belt of the present embodiment.

Furthermore, the surface layer preferably has an unevenness shape such as a groove in the outer surface thereof. The outer surface has the unevenness shape, such that a contact area with another contact member such as a cleaning blade becomes smaller, and the adhesion of the toner to the outer surface can be thus further reduced.

A method of forming the unevenness shape is not particularly limited. An example of the method of forming the unevenness shape can include a method of rotating an intermediate transfer belt having the surface layer supported by a core or the like in a circumferential direction while being in contact with a wrapping film having an abrasive grain, and polishing a surface of the surface layer. In addition, a method such as imprint machining in which a mold machined in a desired shape in advance is brought into contact with the surface of the surface layer can also be used.

Figure 4:
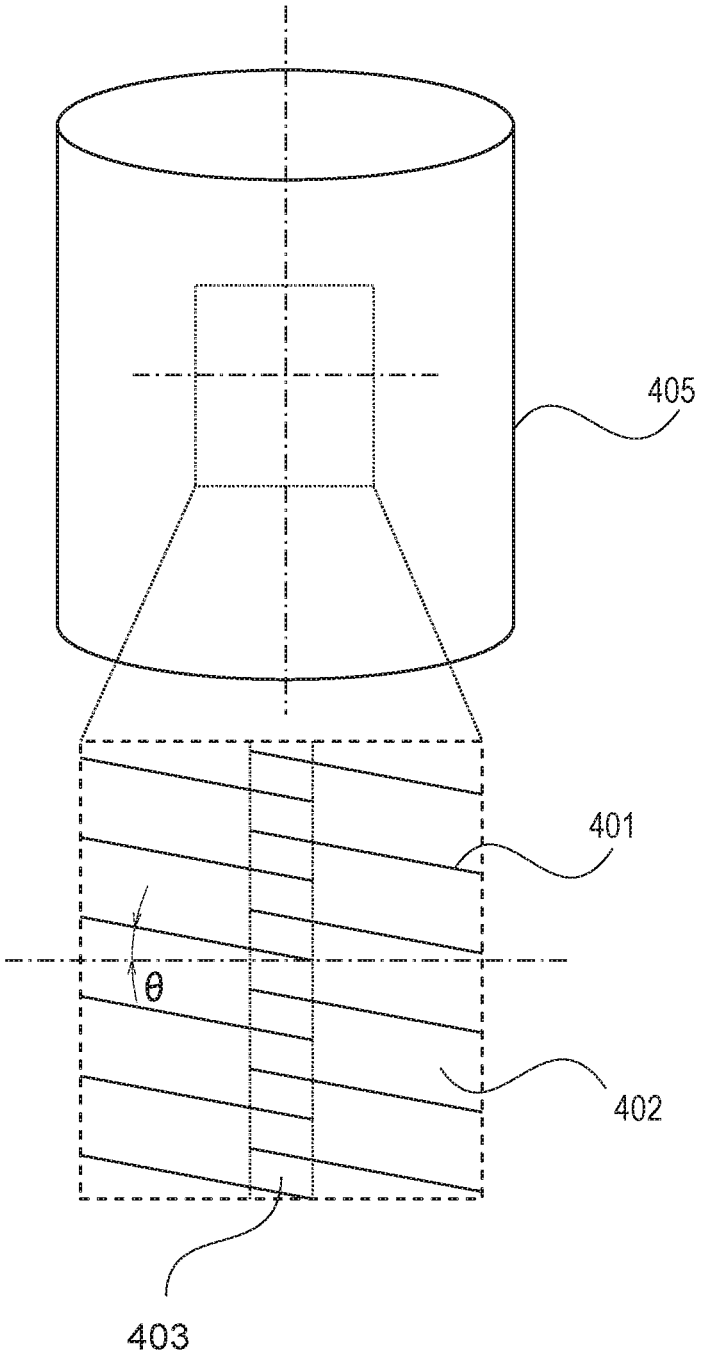
FIG. 4 is an explanatory view of an electrophotographic belt having grooves formed in an outer surface thereof according to another embodiment of the present disclosure.

FIG. 4 is an explanatory view of an electrophotographic belt having grooves formed in an outer surface thereof according to another embodiment of the present disclosure. Grooves 401 are formed in the surface on an outer circumferential side of an electrophotographic belt 405 (hereinafter, also referred to as an "outer surface"). When a straight line is assumed to be placed in a direction orthogonal to a circumferential direction of the electrophotographic belt 405, each of the grooves 401 intersects the straight line and extends in non-parallel to the circumferential direction. Specifically, a narrow angle θ of each of the grooves 401 with respect to the circumferential direction is preferably more than 0° and less than ±3°. The narrow angle θ is more preferably less than ±1°. When the narrow angle of the groove 401 with respect to the circumferential direction is in the above range, a portion of the cleaning blade in contact with a region of the electrophotographic belt that is interposed between two grooves 401 adjacent to each other is not fixed, such that only the portion can be prevented from being worn.

The grooves 401 are provided in the outer surface of the electrophotographic belt. The outer surface of the electrophotographic belt is composed of only first regions 402 in which the number of grooves intersecting a virtual straight line in the direction orthogonal to the circumferential direction of the electrophotographic belt is n and second regions 403 in which the number of grooves intersecting the virtual straight line is greater than n. The first region and the second region are alternately disposed in the circumferential direction. The number n of the grooves 401 is an integer of 1 or more, and is not particularly limited as long as toner cleaning can be stably performed, but the number n of the grooves 401 is preferably 2,000 to 120,000. When the number of the grooves is 2,000 or more, an area of a portion of a cleaning member (cleaning blade) in contact with the portion in which the groove 401 is not formed is reduced, such that a frictional force generated between the cleaning blade and the electrophotographic belt 405 can be reduced. When the number of the grooves is 120,000 or less, a toner in the groove 401 can be further preferably transferred.

The number of the grooves formed in the second region is preferably 2n−10 or more and 2n+10 or less. When the number of the grooves formed in the second region is 2n−10 or more, a location of a contact portion of the cleaning blade in a boundary between the first region and the second region can be stably changed. In addition, when the number of the grooves in the second region is 2n+10 or less, the toner in the groove can be further preferably transferred.

In each of the grooves, intervals between the grooves adjacent to each other are not particularly limited, but are preferably approximately equal from the viewpoint of the toner cleaning. The intervals are approximately equal, such that wear of the blade can be locally suppressed.

A length of the second region in the circumferential direction is preferably 0.01 to 50 mm. In addition, the grooves may be discontinuous in the circumferential direction, and the second region may include ends of each of the grooves. When the length of the second region in the circumferential direction is 50 mm or less, the toner in the groove can be further preferably transferred.

At least one second region is present on the outer surface of the electrophotographic belt 405. In particular, one to three second regions are preferably present, and two or three second regions are more preferably present in the circumferential direction. When two or three second regions are present in the circumferential direction of the electrophotographic belt, the toner in the groove can be further preferably transferred.

A depth of the groove 401 is preferably 0.10 μm or more and less than 5.0 μm, and more preferably 0.20 μm or more and 2.0 μm or less. When the depth of the groove is in the above ranges, a contact state of the cleaning blade to the electrophotographic belt can be stable over a long period of time.

A width of the groove is preferably 0.10 μm or more and less than 3.0 μm, and more preferably 0.20 μm or more and 2.0 μm or less. When the width of the groove is in the above ranges, transferability of the toner can be maintained, and image quality can be maintained by the electrophotographic belt. Examples of a machining method for forming the groove can include known machining methods such as cutting machining, etching machining, and imprint machining Imprint machining is preferable from the viewpoint of machining reproducibility or a machining cost of the groove.

A thickness of the electrophotographic belt 405 is preferably 10 μm or more and 500 μm or less, and particularly preferably 30 μm or more and 150 μm or less. In addition, the electrophotographic belt 405 of the present embodiment may be used not only as a belt but also used as an electrophotographic member for winding or covering a drum or a roll.

<Electrophotographic Image Forming Apparatus>

Figure 1:
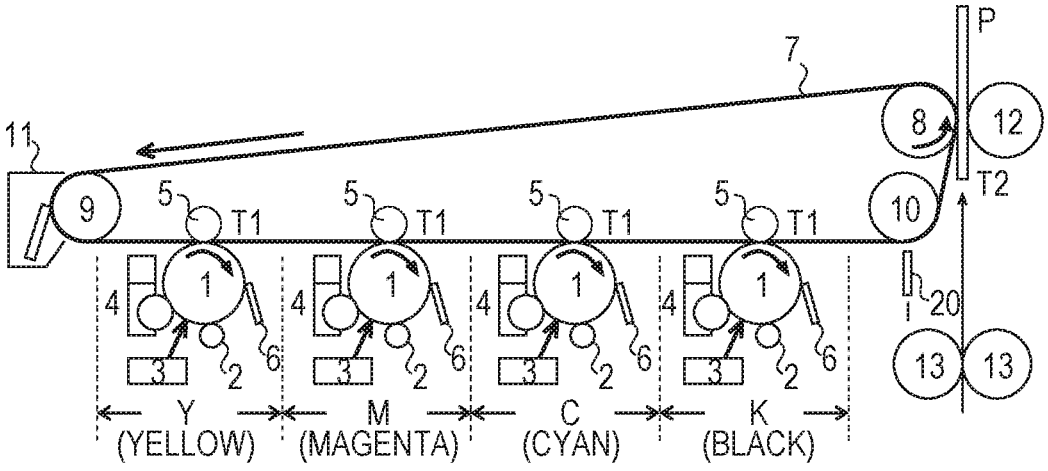
FIG. 1 is a schematic cross-sectional view illustrating an example of an electrophotographic image forming apparatus according to an embodiment of the present disclosure.

FIG. 1 is a schematic cross-sectional view of an electrophotographic image forming apparatus (hereinafter, also referred to as an "electrophotographic apparatus") according to an embodiment of the present disclosure including the electrophotographic member according to an embodiment of the present disclosure as an intermediate transfer belt.

As illustrated in FIG. 1, the electrophotographic apparatus is provided with a total of four process units serving as image forming units including a charging unit, an exposing unit, a developing unit, and a cleaner for each color around a drum-like electrophotographic photosensitive member (hereinafter, denoted by a photosensitive drum) as an image carrier. Images formed on the photosensitive drum by each process unit are sequentially transferred multiply onto the intermediate transfer belt adjacent to the drum and moving and passing through the drum in primary transfer portions, and a full-color toner image is thus formed. Thereafter, the toner images formed on the intermediate transfer belt are collectively transferred onto a recording material in a secondary transfer portion. The toner image on the recording material is thereafter melted, bonded, and fixed onto the recording material by heat or pressure in a fixing portion.

Hereinafter, the electrophotographic apparatus will be described in detail.

The image forming apparatus includes four (first to fourth) image forming units Y, M, C, and K which are sequentially disposed in parallel from the left side to the right side in the drawing. Each of the image forming units Y, M, C, and K is a mechanism of a laser scanning exposure type electrophotographic process having a same configuration, and includes a photosensitive drum 1 as an image carrier. In addition, each of the image forming units includes a charging roller 2 as a charging unit, an exposing device 3 as an exposing unit, a developing device 4 as a developing unit, a primary transfer roller 5 as a primary transfer unit, a drum cleaner 6, and the like that are electrophotographic process units acting on the photosensitive drum 1.

An intermediate transfer belt 7 is stretched by three parallel rollers including a secondary transfer counter roller 8 serving as a drive roller, a deviation correction roller 9 serving as a tension roller, and a driven roller 10. The deviation correction roller 9 is disposed close to the first image forming unit Y, the secondary transfer counter roller 8 is disposed close to the fourth image forming unit K, and the driven roller 10 is disposed at a position below the secondary transfer counter roller 8. A lower surface of the intermediate transfer belt between the deviation correction roller 9 and the driven roller 10 is in contact with an upper surface of the photosensitive drum 1 of each of the image forming units Y, M, C, and K. In addition, a deviation of the intermediate transfer belt can be controlled through alignment adjustment by the deviation correction roller 9.

The primary transfer roller 5 of each of the image forming units Y, M, C, and K is disposed in an inner side of the intermediate transfer belt between the deviation correction roller 9 and the driven roller 10, and the primary transfer roller 5 is pressed to contact with the upper surface of the photosensitive drum 1 with the intermediate transfer belt 7 interposed between the primary transfer roller 5 and the photosensitive drum 1. A contact portion between the photosensitive drum 1 of each of the image forming units Y, M, C, and K and the intermediate transfer belt 7 is a primary transfer nip portion T1. A contact portion between the intermediate transfer belt 7 and a secondary transfer roller 12 is a secondary transfer nip portion T2. A pair of registration rollers 13 are disposed on an upstream side of the secondary transfer nip portion T2 in a conveyance direction of the recording material. In addition, a recording material conveyance belt device and a fixing device (not illustrated) are sequentially disposed on a downstream side of the secondary transfer nip portion T2 in the conveyance direction of the recording material.

An operation for forming a full-color image is as follows. The first to fourth image forming units Y, M, C, and K are driven at a predetermined control timing for an image formation sequence. Each photosensitive drum 1 is rotatably driven by the driving at a predetermined constant speed in a clockwise direction indicated by the arrow. Then, the intermediate transfer belt 7 is also rotated by the secondary transfer counter roller 8 at the same speed as the rotational speed of the photosensitive drum 1 in a counterclockwise direction indicated by the arrow.

A surface of the photosensitive drum 1 which rotates is uniformly charged with a predetermined polarity and potential by the charging roller 2. The charged surface of the photosensitive drum 1 is subjected to image exposure by the exposing device 3. In the present embodiment, the exposing device 3 is a laser scanner. The exposing device 3 outputs a laser beam modulated in accordance with an image information signal to perform scanning exposure on the charged surface of the photosensitive drum 1. As a result, an electrostatic image (electrostatic latent image) corresponding to a scanning exposure pattern is formed on the surface of the drum. The formed electrostatic image is developed as a toner image by the developing device 4.

Through the electrophotographic process described above, in the first image forming unit Y, a yellow toner image corresponding to a yellow component image among color separation component images of the full-color original image is formed on the surface of the photosensitive drum 1. A magenta toner image corresponding to a magenta component image and a cyan toner image corresponding to a cyan component image are formed in the second image forming unit M and the third image forming unit C, respectively, at a predetermined control timing. In addition, a black toner image corresponding to a black component image is formed in the fourth image forming unit K at a predetermined control timing.

Then, in the primary transfer nip portion T1 of the first image forming unit Y, the yellow toner image formed on the photosensitive drum 1 is primarily transferred onto the intermediate transfer belt 7 which is rotatably driven. Next, in the primary transfer nip portion T1 of the second image forming unit M, the magenta toner image formed on the photosensitive drum 1 is primarily transferred onto the intermediate transfer belt 7 while being superimposed on the yellow toner image. Further, similarly, the cyan toner image and the black toner image are sequentially and primarily transferred onto the intermediate transfer belt 7 in the primary transfer nip portions T1 of the third image forming unit C and the fourth image forming unit K, respectively.

That is, color toner images of a total of four colors of yellow, magenta, cyan, and black are sequentially overlapped (multiplexed) and transferred onto the intermediate transfer belt 7 while being superimposed on a predetermined position, and an unfixed full-color toner image is thus formed in a synthesis manner. Primary transfer of the toner image from the photosensitive drum 1 onto the intermediate transfer belt 7 in each primary transfer nip portion T1 is as follows. That is, a predetermined primary transfer bias is applied from a primary transfer power source unit (not illustrated) to the primary transfer roller 5, and the toner image is electrostatically transferred onto the intermediate transfer belt 7 from the photosensitive drum 1.

The primary transfer bias has polarity reverse to charge polarity of the toner and is a direct current voltage having a predetermined potential. In addition, the surface of the photosensitive drum 1 in each of the image forming units Y, M, C, and K after passing through the primary transfer nip portion is cleaned through removal of toner residues after the primary transfer by the drum cleaner 6, and the surface of the photosensitive drum 1 is repeatedly used for image formation.

The unfixed full-color toner image formed on the intermediate transfer belt 7 in the synthesis manner as described above is conveyed by continuous rotation of the intermediate transfer belt 7, and then reaches the secondary transfer nip portion T2 which is the contact portion between the secondary transfer roller 12 and the intermediate transfer belt 7. At the timing when a leading end of the unfixed full-color toner image formed on the intermediate transfer belt 7 reaches the secondary transfer nip portion T2, start of the rotation of the pair of the registration rollers 13 is controlled so that the leading end coincides with a print starting position of a recording material P in the secondary transfer nip portion T2. During a process in which the recording material P is conveyed while being interposed in the secondary transfer nip portion T2, a secondary transfer bias having polarity reverse to the charge polarity of the toner from a secondary transfer power source unit is applied to the secondary transfer roller 12. The secondary transfer bias has the polarity reverse to the charge polarity of the toner and is a direct current voltage having a predetermined potential.

As a result, the unfixed full-color toner images formed on the intermediate transfer belt 7 are collectively and secondarily transferred onto the recording material P. The recording material P coming out from the secondary transfer nip portion T2 is separated from the intermediate transfer belt 7 and is introduced to the fixing device by the recording material conveyance belt device. Then, the toners of each of the color toner images are melted and the colors thereof are mixed with each other, and then the toners are fixed onto a surface of the recording material as a full-color printed image (formed as a fixed image). Thus, a full-color print is discharged out of the apparatus.

A surface of the intermediate transfer belt 7 after the separation of the recording material is cleaned by an intermediate transfer belt cleaner 11 through removal of residual toners after the secondary transfer during the continuous rotation of the intermediate transfer belt 7, and the following operation process is provided. In the intermediate transfer belt cleaner 11, a cleaning member (blade) is brought into contact with the surface of the intermediate transfer belt 7 to scrape the residual toner after the secondary transfer which adheres to the surface of the belt. Then, the residual toner is recovered as a recovered toner in a recovered toner box in the intermediate transfer belt cleaner 11.

A patch detection sensor 20 (toner image detection unit) having a function to detect an image density is provided at a position facing the intermediate transfer belt stretched by the driven roller 10. The patch detection sensor 20 is a sensor optically detecting reflected light and scattered light of light with which a toner image for adjustment (patch image) formed on the intermediate transfer belt is irradiated.

During a period not including a period in which the toner image secondarily transferred onto the recording material is primarily transferred onto the intermediate transfer belt, the toner image for adjustment (patch image) is formed on the intermediate transfer belt. Image formation conditions are adjusted depending on the results.

According to an embodiment of the present disclosure, an electrophotographic member capable of further reducing adhesion of a toner to an outer surface can be obtained. In addition, according to an embodiment of the present disclosure, an electrophotographic image forming apparatus that can form a high quality electrophotographic image can be obtained.

EXAMPLES

Hereinafter, the present disclosure will be described in detail with reference to examples and comparative examples, but the present disclosure is not limited thereto. In each example, an intermediate transfer belt was produced as an electrophotographic member of the present disclosure.

Hereinafter, measurement methods and evaluation methods in each example will be described.

<Evaluation of Low Toner Adhesion (Contact Angle)>

The evaluation of the adhesion was determined by a contact angle with respect to normal hexadecane (n-HD). The n-HD contact angle was measured using a contact angle meter (trade name: PCA-11, manufactured by Kyowa Interface Science, Inc.).

<Image Evaluation>

The intermediate transfer belt of each of the examples or the comparative examples was provided instead of an intermediate transfer belt provided in a full-color electrophotographic image forming apparatus (trade name: iRC2620, manufactured by Canon Inc.). Then, the image evaluation was carried out by printing a blue solid image on the entire surface of a recording material (plain paper 4024, manufactured by Xerox Corporation). A printed image was observed with the naked eye and evaluated based on the following criteria.

A: No unevenness is observed on the image.

B: Unevenness is hardly observed on the image.

C: Some unevenness are observed on the image.

<Evaluation of Strength of Surface Layer>

Evaluation of strength of the surface layer was determined by a measured value of hardness of the surface layer. The hardness of the surface layer 22 was measured by using a Berkovich indenter with a microindentation hardness tester (trade name: Nanoindenter G200, manufactured by Agilent Technologies, Inc.). A region of 100 to 200 nm of the surface layer 22 in a thickness direction from the outermost surface of the surface layer 22 was set as a measurement region, and then an average hardness in the region was calculated. The measured value was evaluated based on the following criteria.

Rank A: The hardness is 0.15 GPa or more.

Rank B: The hardness is 0.10 GPa or more and less than 0.15 GPa.

Rank C: The hardness is less than 0.1 GPa.

Materials Used for Preparing Coating Materials for Forming Surface Layer according to Examples and Comparative Examples Materials used for preparing coating materials for forming a surface layer according to the examples and the comparative examples are shown in Tables 1 to 4.

TABLE 1

| <Binder resin (acrylic raw material monomer)> | |
|---|---|
| Monomer 1 | Dipentaerythritol hexaacrylate (DPEH) |
| Monomer 2 | Pentaerythritol tetraacrylate (PETTA) |
| Monomer 3 | Pentaerythritol triacrylate (PETA) |

TABLE 2

| <Perfluoropolyether> | |
|---|---|
| PFPE1 | Ethoxy alcohol group-terminated PFPE (trade name: Fomblin D2, produced by Solvay Specialty Polymers, LLC) |
| PFPE2 | Fluoromethane group-terminated PFPE (trade name: Fomblin M60, produced by Solvay Specialty Polymers, LLC) |
| PFPE3 | Alkoxy silane group-terminated PFPE (trade name: Fluorolink S10, produced by Solvay Specialty Polymers, LLC) |

TABLE 3

| <Ionic liquid> | |
|---|---|
| Ionic liquid 1 | 1-Ethyl-3-methylimidazolium-bis(trifluoromethanesulfonyl)imide (trade name: EMI-TFSI, produced by Kishida Chemical Co., Ltd.) |
| Ionic liquid 2 | 1-Butyl-3-methylimidazolium-bis(trifluoromethanesulfonyl)imide (produced by KANTO Chemical Co., Inc.) |
| Ionic liquid 3 | 1-Butyl-3-methylimidazolium-bis(nonafluorobutanesulfonyl)imide (produced by KANTO Chemical Co., Inc.) |
| Ionic liquid 4 | N,N,N-Tributyl-N-methylammonium-bis(trifluoromethanesulfonyl)imide (trade name: FC-4400, produced by 3M Japan Limited) |
| Ionic liquid 5 | N,N,N-Trioctyl-N-methylammonium-bis(trifluoromethanesulfonyl)imide (trade name: MTOA-TFSI, produced by Toyo Gosei Co., Ltd.) |
| Ionic liquid 6 | 1-Butylpyridinium-bis(trifluoromethanesulfonyl)imide (produced by KANTO Chemical Co., Inc.) |
| Ionic liquid 7 | N-Methyl-N-propylpiperidinium-bis(trifluoromethanesulfonyl)imide (trade name: MPPip-TFSI, produced by Kishida Chemical Co., Ltd.) |
| Ionic liquid 8 | 1-Methyl-1-propylpyrrolidinium-bis(trifluoromethanesulfonyl)imide (trade name: MPPyr-TFSI, produced by Kishida Chemical Co., Ltd.) |
| Ionic liquid 9 | Triethylpentylphosphonium-bis(trifluoromethanesulfonyl)imide (produced by KANTO Chemical Co., Inc.) |
| Ionic liquid 10 | (2-Acryloyloxyethyl)trimethylammonium-bis(trifluoromethanesulfonyl)imide (produced by FUJIFILM Wako Pure Chemical Corporation) |
| Ionic liquid 11 | (2-Methacryloyloxyethyl)trimethylammonium-bis(trifluoromethanesulfonyl)imide (produced by FUJIFILM Wako Pure Chemical Corporation) |
| Ionic liquid 12 | 1-Ethyl-3-methylimidazolium-trifluoromethanesulfonate (trade name: EMI-TF, produced by Toyo Gosei Co., Ltd.) |

TABLE 4

| <Additive> | |
|---|---|
| Dispersant | Trade name: ARON GF-420 (solid content concentration: 35% by mass) produced by Toagosei Co., Ltd. |
| Photopolymerization initiator | Trade name: Irgacure 184 produced by BASF SE |
| Electro-conductive agent | Antimony-doped tin oxide fine particle (trade name: SN-100P, produced by ISHIHARA SANGYO KAISHA, LTD.) |

Preparation of Coating Materials 1 to 21 for Forming Surface Layer

The respective materials were mixed with each other with a stirring type homogenizer (manufactured by AS ONE Corporation) in the amounts described in Tables 5-1 and 5-2 to prepare coating materials 1 to 21 for forming a surface layer.

Preparation of Coating Materials C-1 to C-3 for Forming Surface Layer

The respective materials were mixed with each other with a stirring type homogenizer (manufactured by AS ONE Corporation) in the amounts described in Table 5-3 to prepare coating materials C-1 to C-3 for forming a surface layer.

TABLE 5-1

| | | Coating material for forming surface layer | | | | | | | | | | |
|---|---|---|---|---|---|---|---|---|---|---|---|---|
| | | 1 | 2 | 3 | 4 | 5 | 6 | 7 | 8 | 9 | 10 | 11 |
| Binder resin (raw material) | Monomer 1 | 9.1 | 9.1 | 9.1 | 9.1 | 9.1 | 9.1 | 9.1 | 9.1 | 9.1 | 9.1 | 9.1 |
| | Monomer 2 | 6.5 | 6.5 | 6.5 | 6.5 | 6.5 | 6.5 | 6.5 | 6.5 | 6.5 | 6.5 | 6.5 |
| | Monomer 3 | 5.4 | 5.4 | 5.4 | 5.4 | 5.4 | 5.4 | 5.4 | 5.4 | 5.4 | 5.4 | 5.4 |
| PFPE | PFPE1 | 10.2 | 10.2 | 10.2 | 10.2 | 10.2 | 10.2 | 10.2 | 10.2 | 10.2 | 10.2 | 10.2 |
| Ionic liquid | Ionic liquid 1 | 10.2 | — | — | — | — | — | — | — | — | — | — |
| | Ionic liquid 2 | — | 10.2 | — | — | — | — | — | — | — | — | — |
| | Ionic liquid 3 | — | — | 10.2 | — | — | — | — | — | — | — | — |
| | Ionic liquid 4 | — | — | — | 10.2 | — | — | — | — | — | — | — |
| | Ionic liquid 5 | — | — | — | — | 10.2 | — | — | — | — | — | — |
| | Ionic liquid 6 | — | — | — | — | — | 10.2 | — | — | — | — | — |
| | Ionic liquid 7 | — | — | — | — | — | — | 10.2 | — | — | — | — |
| | Ionic liquid 8 | — | — | — | — | — | — | — | 10.2 | — | — | — |
| | Ionic liquid 9 | — | — | — | — | — | — | — | — | 10.2 | — | — |
| | Ionic liquid 10 | — | — | — | — | — | — | — | — | — | 10.2 | — |
| | Ionic liquid 11 | — | — | — | — | — | — | — | — | — | — | 10.2 |
| MEK | | 13.7 | 13.7 | 13.7 | 13.7 | 13.7 | 13.7 | 13.7 | 13.7 | 13.7 | 13.7 | 13.7 |
| Butyl acetate | | 6.3 | 6.3 | 6.3 | 6.3 | 6.3 | 6.3 | 6.3 | 6.3 | 6.3 | 6.3 | 6.3 |
| Dispersant | | 15.1 | 15.1 | 15.1 | 15.1 | 15.1 | 15.1 | 15.1 | 15.1 | 15.1 | 15.1 | 15.1 |
| Photopolymerization initiator | | 2.1 | 2.1 | 2.1 | 2.1 | 2.1 | 2.1 | 2.1 | 2.1 | 2.1 | 2.1 | 2.1 |
| Electro-conductive agent | | 21.5 | 21.5 | 21.5 | 21.5 | 21.5 | 21.5 | 21.5 | 21.5 | 21.5 | 21.5 | 21.5 |

(Unit: parts by mass)

TABLE 5-2

| | | Coating material for forming surface layer | | | | | | | | | |
|---|---|---|---|---|---|---|---|---|---|---|---|
| | | 12 | 13 | 14 | 15 | 16 | 17 | 18 | 19 | 20 | 21 |
| Binder resin (raw material) | Monomer 1 | 9.1 | 9.1 | 9.0 | 8.9 | 9.0 | 9.0 | 9.0 | 9.2 | 10.3 | 7.2 |
| | Monomer 2 | 6.5 | 6.5 | | 6.4 | 6.4 | 6.4 | 6.4 | 6.6 | 7.4 | 5.1 |
| | Monomer 3 | 5.4 | 5.4 | 11.9 | 5.3 | 5.3 | 5.3 | 5.3 | 5.5 | 6.1 | 4.3 |
| PFPE | PFPE1 | — | — | 10.2 | 9.8 | 9.8 | 9.8 | 9.8 | 10.2 | 4.9 | 16.6 |
| | PFPE2 | 10.2 | — | — | — | — | — | — | — | — | — |
| | PFPE3 | | 10.2 | — | — | — | — | — | — | — | — |
| Ionic liquid | Ionic liquid 1 | 10.2 | 10.2 | 10.2 | 2.5 | 3.4 | 4.9 | 6.8 | 15.2 | 3.9 | 8.3 |
| MEK | | 13.7 | 13.7 | 13.7 | 13.5 | 13.5 | 13.5 | 13.5 | 14.0 | 15.6 | 10.9 |
| Butyl acetate | | 6.3 | 6.3 | 6.3 | 15.5 | 14.4 | 12.8 | 10.9 | | 17.9 | 12.5 |
| Dispersant | | 15.1 | 15.1 | 15.1 | 15.4 | 15.5 | 15.5 | 15.5 | 16.0 | 7.6 | 26.1 |
| Photopolymerization initiator | | 2.1 | 2.1 | 2.1 | 2.2 | 2.2 | 2.2 | 2.2 | 2.2 | 2.5 | 1.7 |
| Electro-conductive agent | | 21.5 | 21.5 | 21.5 | 20.5 | 20.5 | 20.5 | 20.5 | 21.2 | 23.7 | 7.2 |

* Unit: parts by mass

TABLE 5-3

| | | Coating material for forming surface layer | | |
|---|---|---|---|---|
| | | C-1 | C-2 | C-3 |
| Binder resin (raw material) | Monomer 1 | 9.1 | 9.1 | 12.3 |
| | Monomer 2 | 6.5 | 6.5 | 8.8 |
| | Monomer 3 | 5.4 | 5.4 | 7.3 |
| PFPE | PFPE1 | 10.2 | 10.2 | — |
| Ionic liquid | Ionic liquid 1 | — | — | 13.8 |
| | Ionic liquid 12 | — | 10.2 | — |
| MEK | | 13.7 | 13.7 | 18.6 |
| Butyl acetate | | 16.5 | 6.3 | 8.6 |
| Dispersant | | 16.0 | 15.1 | — |
| Photopolymerization initiator | | 2.2 | 2.1 | 2.9 |
| Electro-conductive agent | | 20.4 | 21.5 | 27.6 |

(Unit: parts by mass)

Example 1

An electrophotographic belt 1 according to Example 1 was produced by using an intermediate transfer belt formed of polyimide and mounted on a full-color copying machine (trade name: iRC2620, manufactured by Canon Inc.) itself as the base layer 21.

That is, a coating film of the coating material 1 for forming a surface layer was formed on an outer circumferential surface of the base layer 21, and the coating film was dried at a temperature of 70° C. for 3 minutes. Thereafter, the coating film was irradiated with ultraviolet rays so that an integrated light quantity was 500 mJ/cm$^2$ to cure the coating film. As described above, the electrophotographic belt 1 having a surface layer with a film thickness of 4 μm was produced.

The thus obtained intermediate transfer belt 1 was used for the various evaluations described above.

Examples 2 to 21

Electrophotographic belts 2 to 21 according to Examples 2 to 21, respectively, were produced and evaluated in the same manner as that of Example 1, except that the coating materials 2 to 21 for forming a surface layer were used for formation of the surface layer.

The evaluation results of the electrophotographic belts 1 to 21 are shown in Table 6.

TABLE 6

| | Content of PFPE with respect to binder resin (% by mass) | Content of ionic liquid with respect to PFPE (% by mass) | Contact angle (°) | Image quality | Strength of surface layer |
|---|---|---|---|---|---|
| Example 1 | 49 | 100 | 81 | A | B |
| Example 2 | 49 | 100 | 76 | A | B |
| Example 3 | 49 | 100 | 74 | A | B |
| Example 4 | 49 | 100 | 73 | A | B |
| Example 5 | 49 | 100 | 70 | A | B |
| Example 6 | 49 | 100 | 75 | A | B |
| Example 7 | 49 | 100 | 76 | A | B |
| Example 8 | 49 | 100 | 76 | A | B |
| Example 9 | 49 | 100 | 77 | A | B |
| Example 10 | 49 | 100 | 68 | A | A |
| Example 11 | 49 | 100 | 68 | A | A |
| Example 12 | 49 | 100 | 77 | A | B |
| Example 13 | 49 | 100 | 79 | A | B |
| Example 14 | 49 | 100 | 81 | A | B |
| Example 15 | 48 | 25 | 65 | A | A |
| Example 16 | 48 | 35 | 69 | A | A |
| Example 17 | 48 | 50 | 76 | A | A |
| Example 18 | 48 | 69 | 77 | A | A |
| Example 19 | 48 | 150 | 82 | A | B |
| Example 20 | 20 | 81 | 78 | A | A |
| Example 21 | 100 | 50 | 75 | A | B |

Comparative Examples 1 to 3

Electrophotographic belts C-1 to C-3 according to Comparative Examples 1 to 3, respectively, were produced and evaluated in the same manner as that of Example 1, except that the coating materials C-1 to C-3 for forming a surface layer were used for formation of the surface layer.

The evaluation results of the electrophotographic belts C-1 to C-3 are shown in Table 7.

TABLE 7

| | Content of PFPE with respect to binder resin (% by mass) | Content of ionic liquid with respect to PFPE (% by mass) | Contact angle (°) | Image quality | Strength of surface layer |
|---|---|---|---|---|---|
| Comparative Example 1 | 49 | 0 | 63 | B | A |
| Comparative Example 2 | 49 | 100 | 63 | B | B |
| Comparative Example 3 | 0 | — | 41 | C | A |

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-182996, filed Oct. 3, 2019, which is hereby incorporated by reference herein in its entirety.

What is claimed is:

1. An electrophotographic member comprising a base layer and a surface layer laminated in this order in a thickness direction of the electrophotographic member, the surface layer containing a binder resin, perfluoropolyether dispersed in the binder resin, and an ionic liquid, a content of the perfluoropolyether with respect to the binder resin being 20% by mass or more and 100% by mass or less, and the ionic liquid being constituted by a cation and an anion, the anion being represented by the following Formula (1), Formula (1)

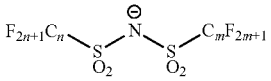

wherein m and n each independently represent an integer of 1 or more and 4 or less, the cation being represented by the following formula (8), Formula (8)

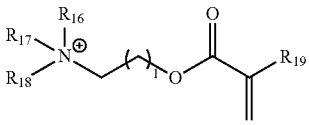

wherein $R_{16}$ to $R_{18}$ each independently represent a hydrocarbon group having 1 to 8 carbon atoms, $R_{19}$ represents hydrogen or a methyl group, and I represents an integer of 1 or more and 8 or less, wherein the ionic liquid is dispersed in the binder resin so that the cation of the ionic liquid interacts with the perfluoropolyether.

2. An electrophotographic member comprising a base layer and a surface layer laminated in this order in a thickness direction of the electrophotographic member, the surface layer containing a binder resin, perfluoropolyether dispersed in the binder resin, and an ionic liquid constituted by a cation and an anion, the ionic liquid being dispersed in the binder resin so that the cation in the ionic liquid interacts with the perfluoropolyether, a content of the perfluoropolyether with respect to the binder resin being 20% by mass or more and 100% by mass or less, and a contact angle of a surface on a side of the surface layer that is opposite to a side facing the base layer with respect to hexadecane being 65° or more, wherein the ionic liquid has an anion and a cation, the anion being represented by the following Formula (1)

Formula (1)

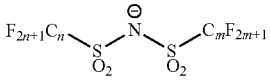

wherein m and n each independently represent an integer of 1 or more and 4 or less, and the cation being represented by the following Formula (8):

Formula (8)

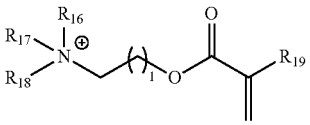

wherein $R_{16}$ to $R_{18}$ each independently represent a hydrocarbon group having 1 to 8 carbon atoms, $R_{19}$ represents hydrogen or a methyl group, and I represents an integer of 1 or more and 8 or less.

3. The electrophotographic member according to claim 1, wherein a content of the ionic liquid with respect to the perfluoropolyether is 25% by mass or more and 150% by mass or less.

4. The electrophotographic member according to claim 1, wherein the binder resin is an acrylic resin.

5. The electrophotographic member according to claim 1, wherein the electrophotographic member is an electrophotographic belt having an endless shape.

6. The electrophotographic member according to claim 5, wherein the electrophotographic belt has grooves formed in a surface on a side of the surface layer that is opposite to a side facing the base layer.

7. The electrophotographic member according to claim 6, wherein when a straight line is assumed to be placed on the surface in a direction orthogonal to a circumferential direction of the electrophotographic belt, the grooves intersect the straight line and extend in a direction non-parallel to the circumferential direction of the electrophotographic belt.

8. The electrophotographic member according to claim 7, wherein the surface on the side of the surface layer that is opposite to the side facing the base layer is composed of only first regions in which a number of the grooves intersecting the straight line is n and second regions in which a number of the grooves intersecting the straight line is greater than n where n represents an integer of 1 or more, and the first region and the second region are alternately disposed in the circumferential direction of the electrophotographic belt.

9. The electrophotographic member according to claim 5, wherein the electrophotographic belt is an intermediate transfer belt.

10. An electrophotographic image forming apparatus comprising an electrophotographic member, wherein the electrophotographic member comprises a base layer and a surface layer laminated in this order in a thickness direction of the electrophotographic member, the surface layer contains a binder resin, perfluoropolyether dispersed in the binder resin, and an ionic liquid, a content of the perfluoropolyether with respect to the binder resin is 20% by mass or more and 100% by mass or less, and the ionic liquid being constituted by a cation and an anion, the anion being represented by the following Formula (1), Formula (1)

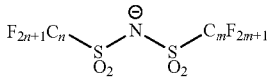

wherein m and n each independently represent an integer of 1 or more and 4 or less, and wherein the ionic liquid is dispersed in the binder resin so that the cation in the ionic liquid interacts with the perfluoropolyether, and the cation being represented by the following formula (8)

Formula (8)

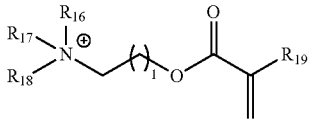

wherein $R_{16}$ to $R_{18}$ each independently represent a hydrocarbon group having 1 to 8 carbon atoms, $R_{19}$ represents hydrogen or a methyl group, and I represents an integer of 1 or more and 8 or less.

11. The electrophotographic image forming apparatus according to claim 10, further comprising a cleaning member disposed in contact with a surface of the electrophotographic member on a side of the surface layer that is opposite to a side facing the base layer.

* * * * *